US005196128A

United States Patent [19]

Crutcher et al.

[11] Patent Number: 5,196,128

[45] Date of Patent: Mar. 23, 1993

[54] LAUNDRY RINSE CONTAINING N-OCTADECYL-N,N-DIMETHYLAMINE OXIDE AND N-DIHYDROGENATEDTALLOW-N,N-DIMETHYLAMMONIUM CHLORIDE

[75] Inventors: Terry Crutcher; Kim R. Smith; James E. Borland; Joe D. Sauer; Jeffrey W. Perine, all of Baton Rouge, La.

[73] Assignee: Ethyl Corporation, Richmond, Va.

[21] Appl. No.: 652,602

[22] Filed: Feb. 8, 1991

[51] Int. Cl.[5] ..... C11D 1/62; C11D 1/75; C11D 1/86

[52] U.S. Cl. ..... 252/8.8; 252/547; 252/173

[58] Field of Search ..... 252/8.8, 547, 173; 8/137

[56] References Cited

U.S. PATENT DOCUMENTS

| | | | |
|---|---|---|---|
| 3,256,180 | 6/1966 | Weiss | 252/8.8 R |
| 3,660,286 | 5/1972 | Sepulveda et al. | 252/8.8 R |
| 3,844,952 | 10/1974 | Booth | 252/8.75 |
| 3,936,538 | 2/1976 | Marshall et al. | 252/8.8 R |
| 4,399,045 | 8/1983 | Burns | 252/8.8 R |
| 4,476,031 | 10/1984 | Ooms | 252/8.8 R |
| 4,897,208 | 1/1990 | Wahl et al. | 252/8.8 R |
| 4,956,447 | 9/1990 | Gosselink et al. | 252/8.8 R |

FOREIGN PATENT DOCUMENTS 62-110977 5/1987 Japan .

OTHER PUBLICATIONS

English Translation of JP 62-110977.

*Primary Examiner*—Paul Lieberman
*Assistant Examiner*—Erin M. Higgins
*Attorney, Agent, or Firm*—Patricia J. Hogan

[57] ABSTRACT

The rewettability of laundered fabrics, such as cotton fabrics, that are softened by the use of a laundry rinse is improved by using as the laundry rinse a rinse comprising an aqueous solution of a mixture of 20–75% by weight of N-octadecyl-N,N-dimethylamine oxide and 80–25% weight of N-dihydrogenatedtallow-N,N-dimethylammonium chloride as the fabric softener.

2 Claims, No Drawings

LAUNDRY RINSE CONTAINING N-OCTADECYL-N,N-DIMETHYLAMINE OXIDE AND N-DIHYDROGENATEDTALLOW-N,N-DIMETHYLAMMONIUM CHLORIDE

FIELD OF INVENTION

This invention relates to laundry rinses and more particularly to such rinses which improve the rewettability of laundered fabrics.

BACKGROUND

When fabrics are laundered, it is frequently desirable to treat them with fabric softeners, not only to soften them, but to give them greater bulk, make them easier to iron, decrease fabric drying time, and reduce static charge. A fabric softener that is commonly used is N-dihydrogenatedtallow-N,N-dimethylammonium chloride (DTMAC), which is both inexpensive and effective as a softener but, on the other hand, has certain deficiencies, such as its yellowing and reducing the washability of the softened fabrics, having inefficient antistatic activity on polyesters, and decreasing the rewettability of the treated fabrics.

Amine oxides, such as N-alkyl-N,N-dimethylamine oxides, are also effective fabric softeners; and fabrics softened with them have been found to have better rewettability than fabrics softened with DTMAC. Thus, it has been proposed to use amine oxides in combination with DTMAC to provide better rewettability than can be obtained with DTMAC as the sole fabric softener. However, when the surfactants have been combined in laundry detergents or in laundry dryer sheets, improved rewettability has not been obtained; and, when an amine oxide such as N-octyl-N,N-dimethylamine oxide is combined with DTMAC in a laundry rinse, the rewettability of the fabric is intermediate to the rewettability of a fabric softened with the amine oxide alone and the rewettability of a fabric softened with DTMAC alone.

SUMMARY OF INVENTION

It has been found that, when the fabric softener is used in a laundry rinse rather than in the laundry detergent or in a laundry dryer sheet, the rewettability of laundered fabrics can be improved by using as the fabric softener an aqueous solution of a synergistic mixture of 20–75% by weight of N-octadecyl-N,N-dimethylamine oxide and 80–25% by weight of N-dihydrogenatedtallow-N,N-dimethylammonium chloride.

DETAILED DESCRIPTION

Except for the fabric softener mixture used, the laundry rinse of the present invention is a conventional rinse which has water as its major ingredient, generally comprising about 70–90% by weight of water, and may contain any of the other ingredients typically used in laundry rinses, e.g., minor amounts of materials such as dyes and perfumes and sometimes an alcohol, such as ethanol, to prevent phase separation, as well as the novel fabric softener mixture. Moreover, the rinse may be prepared as such rinses are normally prepared except for the use of the novel mixture as the fabric softener; and conventional techniques are also suitable for rinsing laundry therewith.

Both ingredients of the fabric softener mixture are well known, and commercially-available materials are utilizable. As already mentioned, they are combined so as to provide mixtures of 20–75% by weight of the amine oxide and 80–25% by weight of the quaternary ammonium chloride.

The fabric softener mixture, regardless of the particular proportionation of components within the specified ranges, provides laundered fabrics, such as cotton, with better rewettability than either component of the mixture when used alone in a laundry rinse; and optimum rewettability is obtained when the fabric softener is a mixture of about 75% by weight of the quaternary ammonium chloride and about 25% by weight or the amine oxide. This advantage of the mixtures is unexpected, since, as already mentioned, such synergism is not obtained when other amine oxides, such as N-octyl-N,N-dimethylamine oxide, are used instead of the N-octadecyl-N,N-dimethylamine oxide.

The following example is given to illustrate the invention and is not intended as a limitation thereof. Unless otherwise specified, quantities mentioned in the example are quantities by weight.

EXAMPLE

A medium-grade cotton terrycloth towel was subjected to four wash/rinse/dryer cycles in which the rinse was an aqueous solution of N-octadecyl-N,N-dimethylamine oxide (AO-18), another such towel was subjected to four wash/rinse/dryer cycles in which the rinse was an aqueous solution of N-dihydrogenatedtallow-N,N-dimethylammonium chloride (DTMAC), and three other such towels were subjected to four wash/rinse/dryer cycles in which the rinse was an aqueous solution of a fabric softener mixture. The mixtures were respectively:

(A) 25% DTMAC and 75% AO-18, (B) 50% DTMAC and 50% AO-18, and (C) 75% DTMAC and 25% AO-18.

The treated towels were tested for rewettability in accordance with CSMA test protocol Method D-13D by cutting the towels into strips measuring 5×6 inches (12.7×15.2 cm), marking each of the strips one centimeter from the narrow edge and lowering it into a 0.01% Rhodamine B dye bath for six minutes, and recording the distance of dye movement at the end of that time in centimeters. The results of the test are shown below.

| | |
|---|---|
| 100% AO-18 | 2.8 cm |
| 75% AO-18/25% DTMAC | 4.0 cm |
| 50% AO-18/50% DTMAC | 4.4 cm |
| 25% AO-18/75% DTMAC | 4.8 cm |
| 100% DTMAC | 1.6 cm |

What is claimed is:

1. A laundry rinse which provides improved rewettability of laundered fabrics and which consists essentially of an aqueous solution of a mixture of 20–75% by weight of N-octadecyl-N,N-dimethylamine oxide and respectively 80–25% by weight of N-dihydrogenatedtallow-N,N-dimethylammonium chloride as a fabric softener.

2. The laundry rinse of claim 1 wherein the fabric softener is a mixture of about 25% by weight of the amine oxide and about 75% by weight of the substituted ammonium chloride.

* * * * *